US006546917B2

(12) United States Patent
Onishi et al.

(10) Patent No.: US 6,546,917 B2
(45) Date of Patent: Apr. 15, 2003

(54) VARIABLE DELIVERY FUEL SUPPLY DEVICE

(75) Inventors: Yoshihiko Onishi, Tokyo (JP); Kouichi Ojima, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/844,278

(22) Filed: Apr. 30, 2001

(65) Prior Publication Data

US 2002/0040704 A1 Apr. 11, 2002

(30) Foreign Application Priority Data

Oct. 5, 2000 (JP) ..... 2000-305979

(51) Int. Cl.[7] ..... F02M 37/04
(52) U.S. Cl. ..... 123/506; 123/496
(58) Field of Search ..... 123/446, 514, 123/456, 506, 447, 503

(56) References Cited

U.S. PATENT DOCUMENTS 4,643,155 A * 2/1987 O'Neill ..... 123/506
5,094,216 A * 3/1992 Miyaki et al. ..... 123/506
5,197,438 A * 3/1993 Kumano et al. ..... 123/506
5,345,916 A * 9/1994 Amann et al. ..... 123/506
6,016,790 A * 1/2000 Makino et al. ..... 123/496
6,135,090 A 10/2000 Kawachi et al. ..... 123/446
6,314,945 B1 * 11/2001 Sugiyama et al. ..... 123/506

* cited by examiner

*Primary Examiner*—Carl S. Miller
(74) *Attorney, Agent, or Firm*—Sughrue Mion, PLLC

(57) ABSTRACT

A variable delivery fuel supply device capable of improving linearity of discharge characteristics with respect to a rotational angle of a cam and reducing abrasion of the cam. The variable delivery fuel supply device comprises: fuel injection valves 1*a* to 1*d* respectively for injecting a fuel to cylinders of an internal combustion engine; a delivery pipe 2 for supplying a pressurized fuel to said fuel injection valves 1*a* to 1*d*; and a fuel pump 3 for taking a fuel from a fuel intake passage 24 through an intake valve 25 into a pressurization chamber 17 during an intake stroke, for pressurizing the fuel and for discharging the pressurized fuel through a discharge valve 26 to the delivery pipe 2 during a discharge stroke by reciprocating movement of a plunger 14 in each cylinder 13 from a bottom dead point to a top dead point; wherein the pressure in the pressurization chamber 17 is relieved at a position set to a predetermined value before reaching the top dead point in the course of the discharge stroke in which the plunger 14 of the fuel pump 3 moves from the bottom dead point to the top dead point.

4 Claims, 6 Drawing Sheets

VARIABLE DELIVERY FUEL SUPPLY DEVICE

BACKGROUND OF THE INVENTION

1. Technical Field

The present invention relates to a variable delivery fuel supply device, which is used in an internal combustion engine for vehicles, supplies a pressure fuel to a fuel injection valve, and controls quantity of a fuel supplied to the fuel injection valve.

2. Background Art

A variable delivery fuel supply device for supplying a pressure fuel to a fuel injector of an internal combustion engine for vehicles is, as disclosed, for example, in the Japanese Patent publication (unexamined) No. 200990/1999, is comprised of: a fuel injection valve for injecting a fuel to each cylinder of the internal combustion engine; a delivery pipe (common rail) for distributing and supplying a pressure fuel to this fuel injection valve; a high pressure fuel pump for supplying the fuel to the delivery pipe; a low pressure fuel pump for supplying the fuel from a fuel tank to the high pressure fuel pump; and control means for controlling amount and time of injecting the fuel to each cylinder, controlling an electromagnetic valve (fuel pressure control valve) disposed in the high pressure fuel pump to release a part of the pressure fuel to a relief oil passage, and controlling discharge quantity of the high pressure fuel pump, thereby controlling fuel pressure of the delivery pipe.

The high pressure fuel pump is comprised of: a cylinder, a plunger which is driven by a cam disposed on a camshaft of the internal combustion engine to reciprocate in the cylinder, takes (sucks) the fuel into a pressurization chamber in the cylinder during an intake stroke while pressurizing the fuel in the pressurization chamber and delivering the pressurized fuel with pressure to the delivery pipe during a discharge stroke; the mentioned electromagnetic valve, and so on. This electromagnetic valve is a normally closed electromagnetic valve that is closed under normal conditions and is opened upon receiving an electric signal (valve-opening signal). The control means controls discharge quantity of the high pressure fuel pump by computing a discharge quantity from feedback of a fuel necessary for the fuel injection valve and a fuel pressure in the delivery pipe and determining a time for opening the electromagnetic valve. The electromagnetic valve is opened at the predetermined time, and the fuel pressure in the delivery pipe is maintained at a predetermined value by relieving a part of the pressure fuel to the relief oil passage. A valve-opening signal is given from the control means to the electromagnetic valve in the discharge stroke of the plunger of the high-pressure fuel pump. A signal width of the valve-opening signal is determined so that the valve may be closed upon completion of the discharge stroke, i.e., along with the beginning of the intake stroke, or during the intake stroke.

FIG. 7 is a diagram to explain signal width of the valve-opening signal and an operating condition of the high-pressure fuel pump in the mentioned conventional device. The drawing shows one reciprocating motion, i.e. operation in one cycle, and in the case that the cam has, for example, four tops, the drawing shows the operation during a quarter of one revolution (90° in rotational angle) of the cam. It is understood from the drawing that, in one cycle, the discharge stroke occupies 45° and the intake stroke occupies 45°. When the discharge quantity reaches a predetermined value at a point (a) in the discharge stroke, a valve-opening signal is given to the electromagnetic valve, and the fuel in the pressurization chamber is relieved to the relief oil passage during the period from the point (a) to the top dead point. Controlling the position of the point (a) controls the discharge quantity. When a flow rate required by the control means is large with respect to the discharge quantity of the high pressure fuel pump, for example, when an amount of fuel used by the internal combustion engine is large or when fuel pressure of the delivery pipe is increased from a low pressure to a high pressure such as at the time of starting, the electromagnetic valve is kept closed until coming near the top dead point.

FIG. 8 shows an amount of lift of the plunger (hereinafter referred to as plunger lift amount) with respect to the rotational angle of the cam in such operation, and is an enlarged diagram of the mentioned 45° from the bottom dead point to the top dead point of the plunger lift amount shown in FIG. 7. A curve indicated by the solid line in the drawing is a lift curve of the cam shown in the form of a sine curve. The fuel discharge quantity with respect to the cam angle in a predetermined number of revolutions in this case becomes a discharge characteristic curve as indicated by the solid line in FIG. 9. The discharge flow rate with respect to the valve-opening time (shown in terms of rotational angle of the cam) is lowered more in linearity as the plunger approaches the top dead point. In the operation, the pressure in the pressurization chamber generates a Hertz stress between the cam and the plunger. The solid line in FIG. 10 indicates the Hertz stress with respect to the cam angle under a predetermined discharge pressure. When the lift of the cam is a sine curve, the Hertz stress sharply increases because the radius of curvature of the cam becomes small in the vicinity the top dead point of the plunger.

Such increase in Hertz stress brings about an abrasion on the contact surface of the cam, and this abrasion changes the discharge quantity. Therefore, the lift curve of the cam is changed into a lift curve that is large in radius of curvature in the vicinity of the top dead point (the cam top portion of the cam) as indicated by the dotted line in FIG. 8 to lower the Hertz stress which is a counter-measure to the abrasion. The discharge flow rate characteristic and the Hertz stress at this time are as indicated by the dotted lines in FIGS. 9 and 10. It is certain that the Hertz stress in the vicinity of the plunger top dead point is lowered. But, on the contrary, linearity of the discharge flow rate is lowered. Assuming that the top dead point side of the discharge stroke is 100%, increase in discharge quantity with respect to the rotational angle of the cam becomes extremely small in the range of approximately 80% to 100% of the discharge stroke. In such a range controllability is deteriorated remaining only a large Hertz stress.

As discussed above, in the mentioned conventional variable delivery fuel supply device, the whole period of the discharge stroke is occupied by the valve-closing time of the electromagnetic valve under the condition that fuel consumption is close to the discharge quantity. As a result, a problem exists in that the Hertz stress increases in the vicinity of the top dead point leading to an abrasion on the contact face of the cam, and if such an abrasion develops further, the lift of the plunger is lowered and the discharge quantity becomes poor. And the linearity of the discharge characteristic lowers and the controllability of the discharge flow rate is deteriorated as the plunger approaches the top dead point. Further, in the conventional example, since the pressure in the pressurization chamber is forcibly lowered to an intake pressure in a short time at the time of opening the electromagnetic valve under normal conditions, the intake valve is opened when the plunger moves downward during the intake stroke. On the other hand, since the valve is kept closed throughout the whole stroke of the discharge stroke and the intake stroke at the time of obtaining the maximum discharge quantity, it takes a certain time to lower the fuel pressure in the pressurization chamber even after the stroke is shifted to the intake stroke and the plunger begins to move downward because of bulk modulus of the fuel. As a result, a further problem exists in that there is not enough time for sufficiently taking in the fuel under the conditions of high numbers of revolution and a high fuel pressure, which brings about cavitation and deterioration in durability.

Moreover, the lift curve is changed as a counter-measure to the abrasion of the cam due to the Hertz stress in the foregoing description, and this change is, as described above, to lower the Hertz stress by increasing the radius of curvature of the cam top portion. In this case, to assure the amount of lift of the cam, it is necessary to decrease curvature of a cam base portion, which means that a component of higher order is added to the lift curve in the form of sine curve only formed of primary components. In this known measure, it is certainly possible to lower the Hertz stress without enlarging external diameter of the cam. But in the case that, for example, a cam has four tops and speed of revolution of the cam is 3500 r.p.m., the high pressure fuel pump is driven at a frequency of 233 Hz, while the drive frequency of the high pressure fuel pump includes a high frequency of 466 Hz when a component of higher order, for example, any secondary component is added. As a result, a further problem exists in that it is essential to establish resonance point of the intake valve, discharge valve, plunger, spring, and so on, to be higher.

SUMMARY OF THE INVENTION

The present invention was made to resolve the above-discussed problems and has an object of obtaining a variable delivery fuel supply device in which it is possible to improve linearity of discharge characteristic with respect to a rotational angle of a cam and decrease abrasion and cavitation of the cam.

A variable delivery fuel supply device according to the invention comprises fuel injection valves respectively for injecting a fuel to cylinders of an internal combustion engine; a delivery pipe for supplying a pressurized fuel to the mentioned fuel injection valves; and a fuel pump for taking a fuel from a fuel intake passage through an intake valve into a pressurization chamber during an intake stroke, for pressurizing the fuel and for discharging the pressurized fuel through a discharge valve to the delivery pipe during a discharge stroke by reciprocating movement of a plunger in each cylinder from a bottom dead point to a top dead point; wherein the pressure in the pressurization chamber is relieved at a position set to a predetermined value before reaching the top dead point in the course of the discharge stroke in which the plunger of the fuel pump moves from the bottom dead point to the top dead point.

As a result, the pressure in the pressurization chamber is relieved at the time of completion of the discharge stroke and shifting to the intake stroke is performed smoothly. It is possible to prevent deterioration in durability due to cavitation or the like and, at the same time, solve a problem of insufficient filling with the fuel at high numbers of revolutions or at a high load. Further, the pressure applied to the plunger is lowered, and consequently, the Hertz stress acting between a cam top portion of a small radius of curvature of the cam and a roller is largely reduced. Thus it is possible to prevent the cam from abrasion.

It is also preferable that the variable delivery fuel supply device is provided with an electromagnetic valve for controlling a discharge quantity of the fuel pump to control the fuel pressure of the delivery pipe by connecting the fuel intake passage and the pressurization chamber, and the pressure in the pressurization chamber is relieved by opening the electromagnetic valve at a set position.

As a result, it is possible to release the pressure just by changing the control contents of the electromagnetic valve for controlling the discharge quantity.

It is also preferable that the position of the plunger where the pressure in the pressurization chamber is relieved is established to be at 80 to 90% from the bottom dead point side in the whole stroke of the plunger from the bottom dead point to the top dead point.

As a result, it becomes possible to assure linearity of the discharge quantity with respect to the rotational angle of the cam during the period of discharge and improve accuracy in discharge quantity. Furthermore, just by changing a small diameter portion of the cam and changing the plunger lift amount to 1/(0.8 to 0.9) times, it becomes possible to secure the whole discharge quantity of the fuel pump without increasing size, and decrease in discharge quantity is compensated by regulating the discharge control range to meet the abrasion of the cam. Consequently, it is possible to obtain a long-life variable delivery fuel supply device.

It is also preferable that the electromagnetic valve is a normally closed valve, which opens when the discharge quantity is controlled and when the pressure in the pressurization chamber is relieved.

As a result, the pressure in the pressurization chamber is relieved easily, and it is possible to supply a fuel to each cylinder even when any trouble occurs in the drive circuit of the electromagnetic valve and prevent the device from becoming inoperative.

DESCRIPTION OF THE PREFERRED EMBODIMENTS

Embodiment 1

Figure 1:
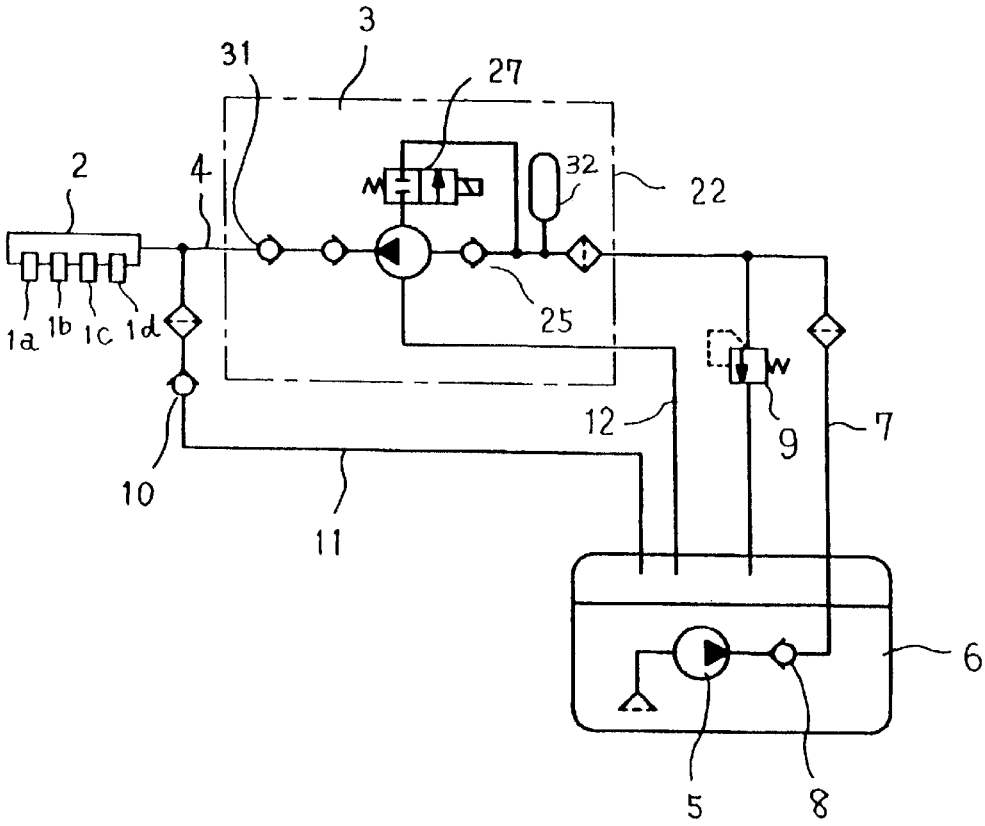
FIG. 1 is a system chart showing a construction of a variable delivery fuel supply device according to Embodiment 1 of the invention.
Figure 2:
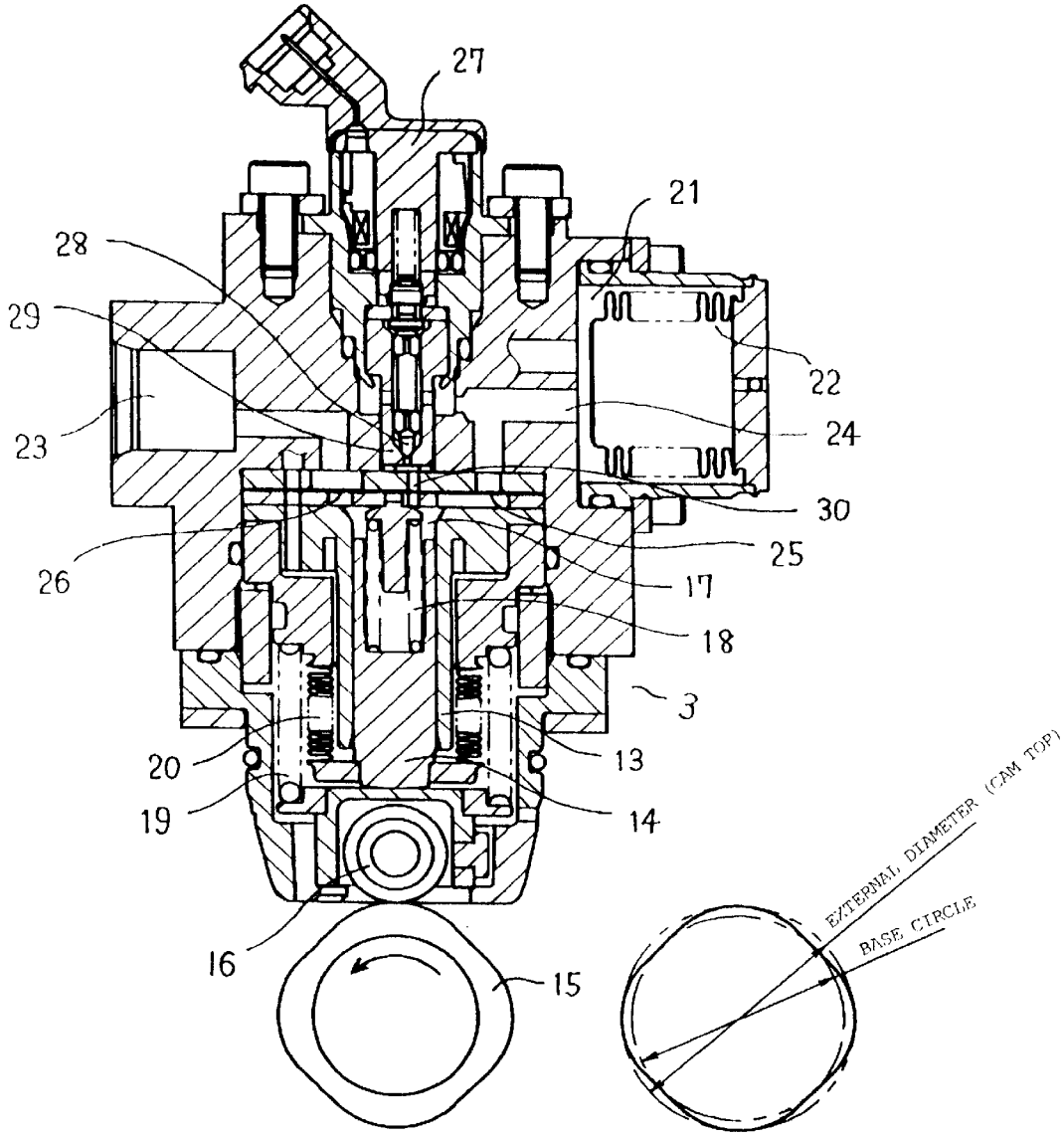
FIG. 2 is a sectional view of a high-pressure fuel pump of the variable delivery fuel supply device according to Embodiment 1 of the invention.
Figure 3:
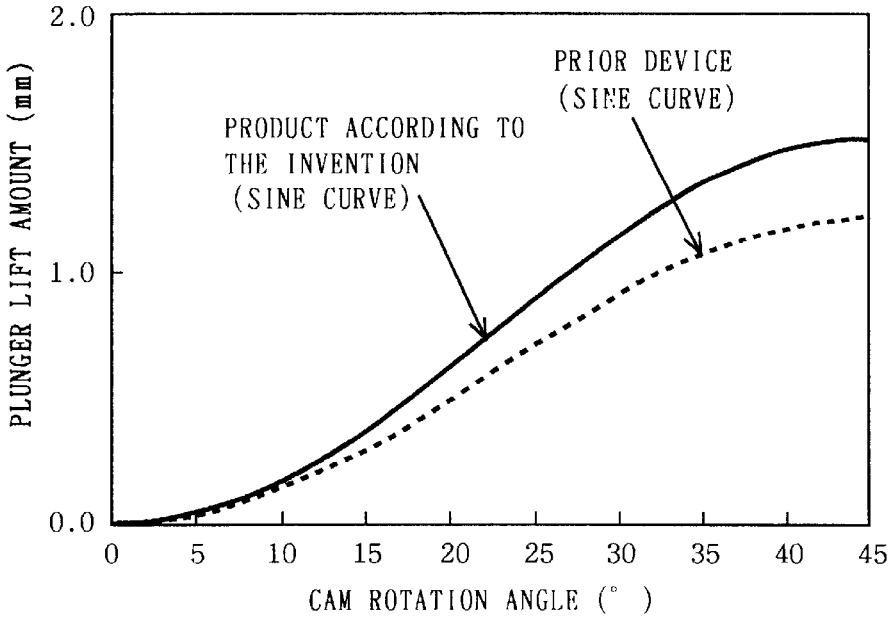
FIG. 3 is a diagram showing a lift of a plunger of the variable delivery fuel supply device according to Embodiment 1 of the invention.
Figure 4:
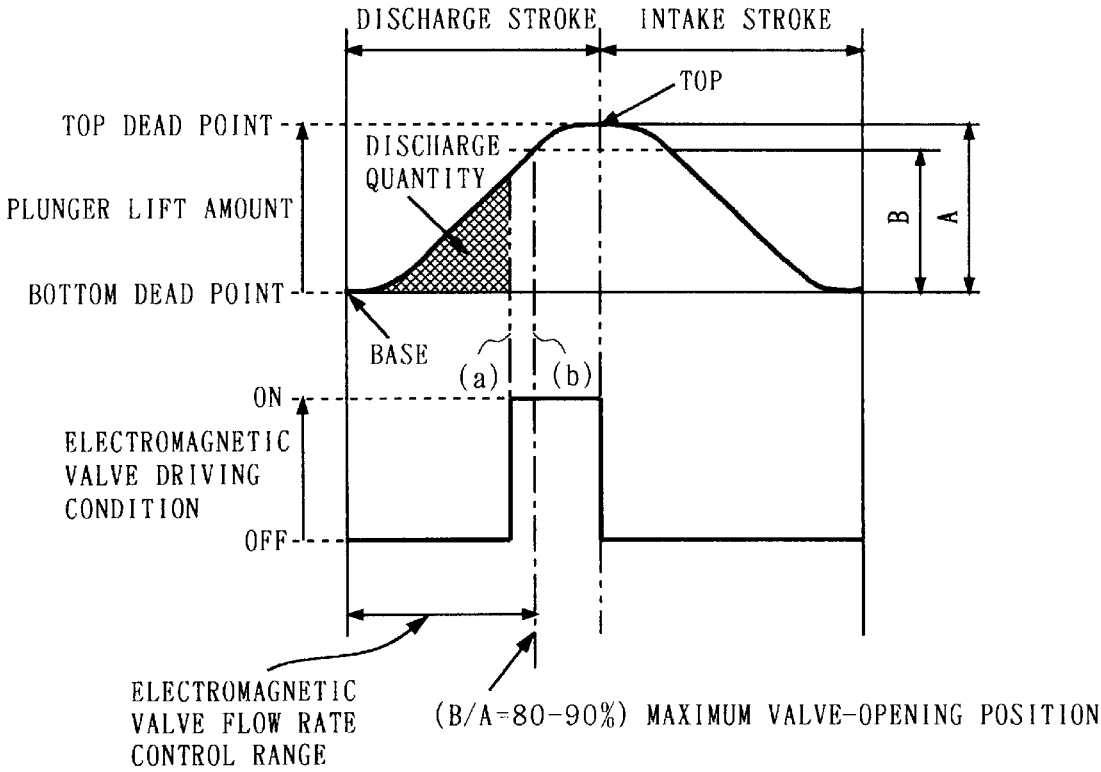
FIG. 4 is a diagram to explain operation of the variable delivery fuel supply-device according to Embodiment 1 of the invention.
Figure 5:
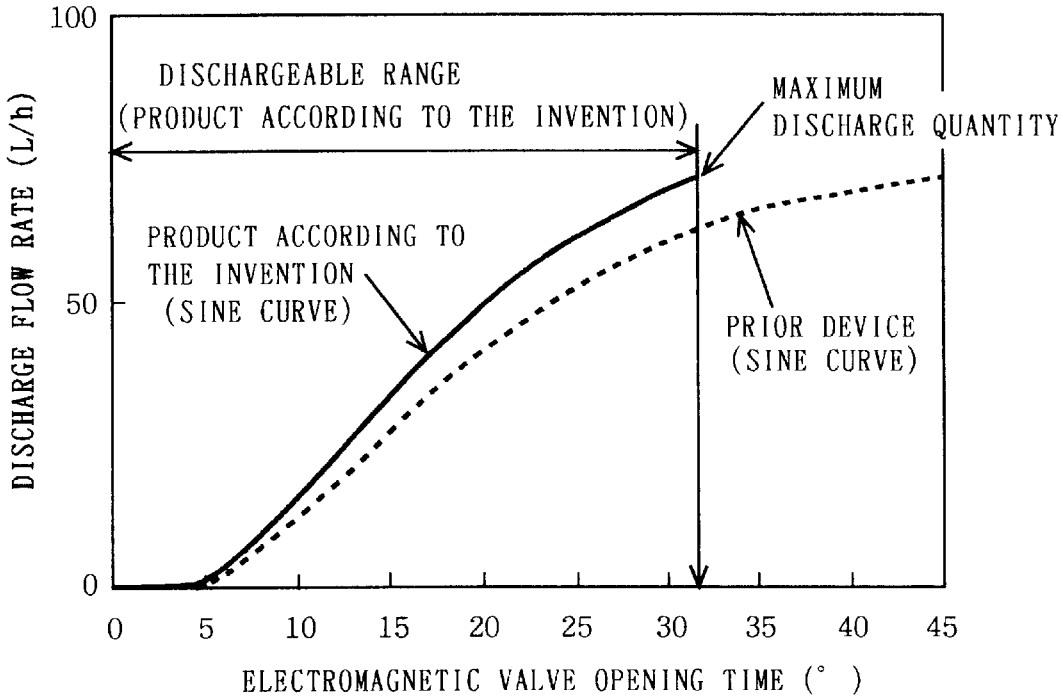
FIG. 5 is a a diagram showing a discharge flow rate characteristic of the variable delivery fuel supply device according to Embodiment 1 of the invention.
Figure 6:
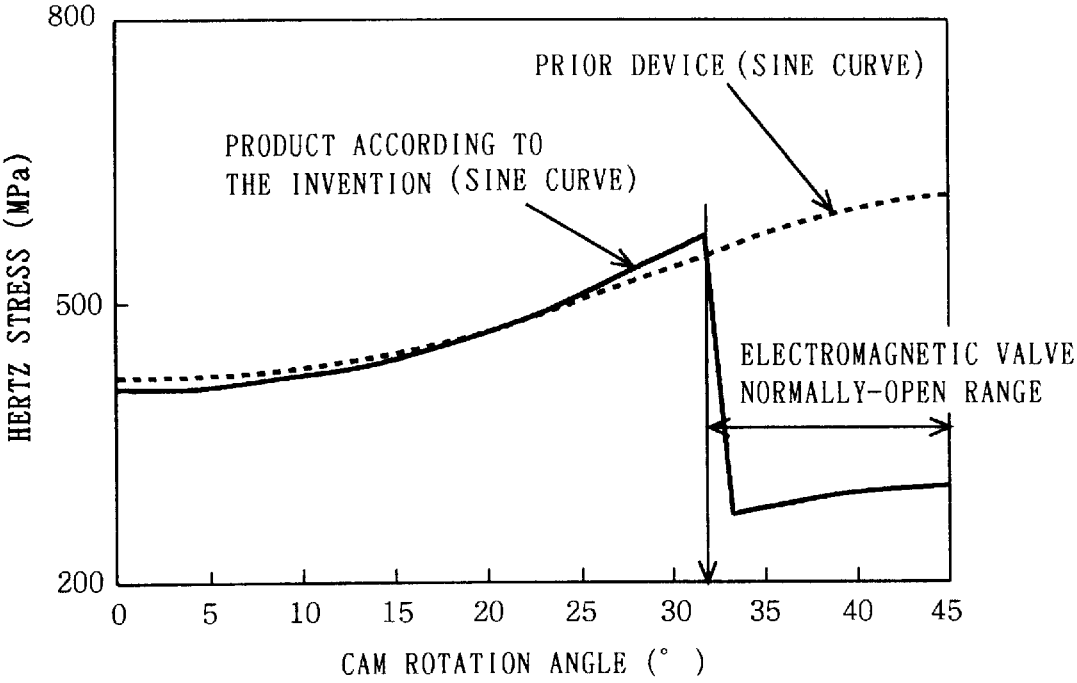
FIG. 6 is a diagram showing a stress characteristic of the variable delivery fuel supply device according to Embodiment 1 of the invention.
Figure 7:
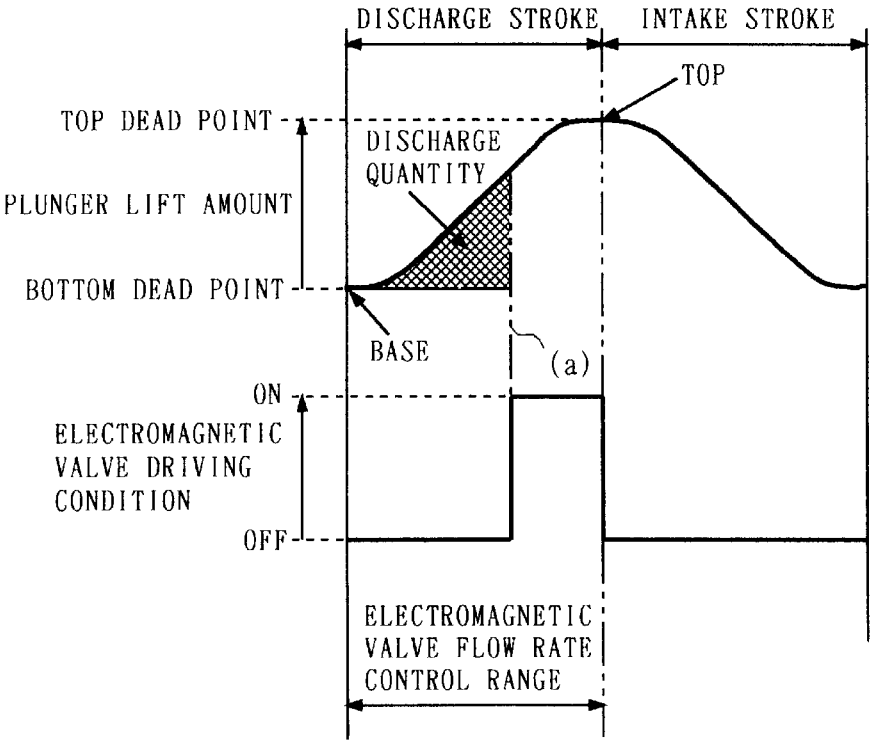
FIG. 7 is a diagram to explain operation of a conventional variable delivery fuel supply device according to the prior art.
Figure 8:
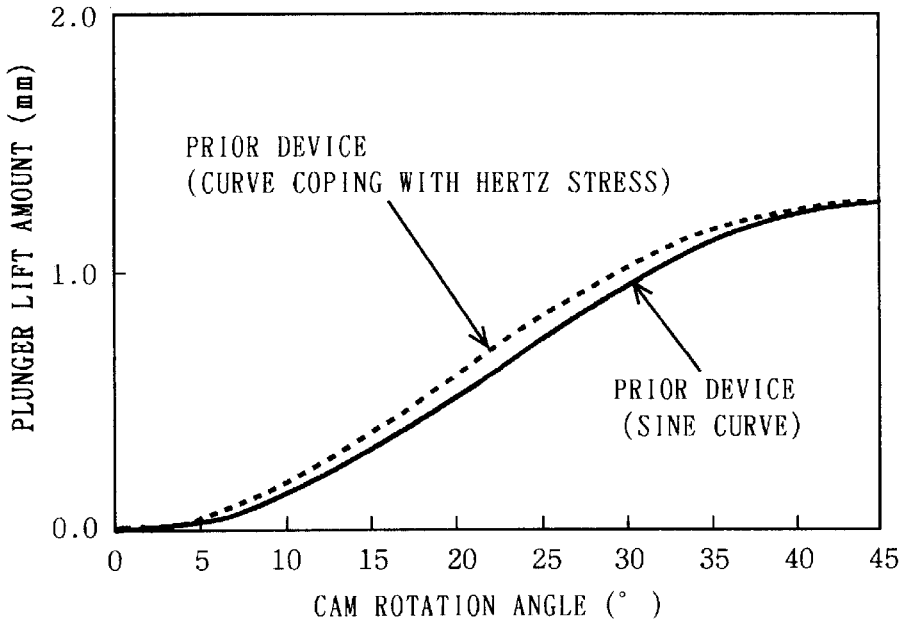
FIG. 8 is a diagram showing a lift of a plunger of the variable delivery fuel,supply device according to the prior art.
Figure 9:
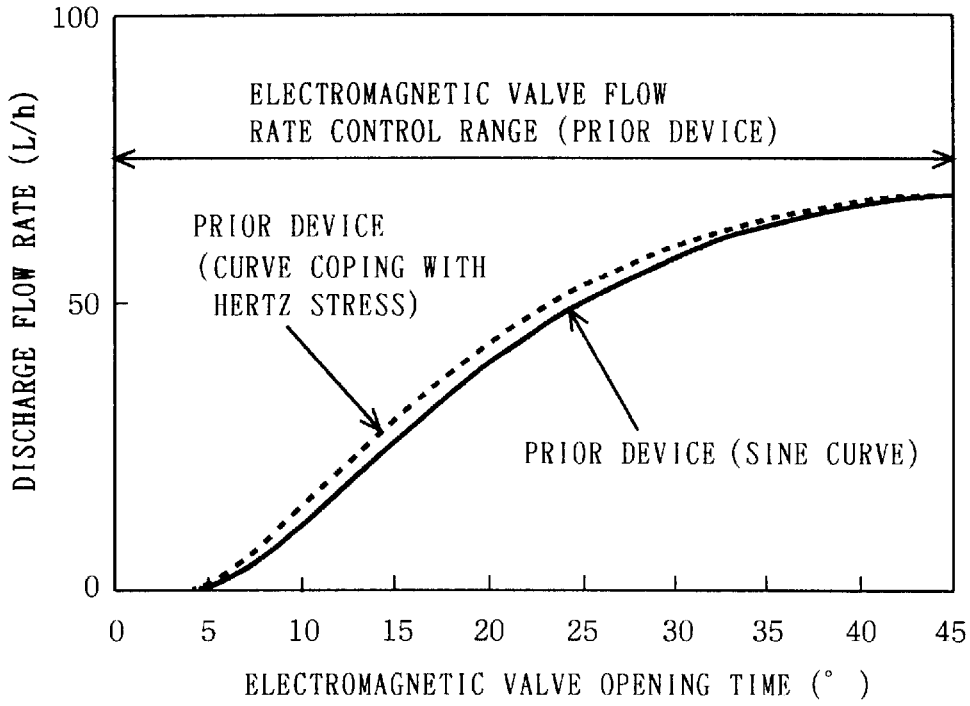
FIG. 9 is a diagram showing a discharge flow rate characteristic of the variable delivery fuel supply device according to the prior art.
Figure 10:
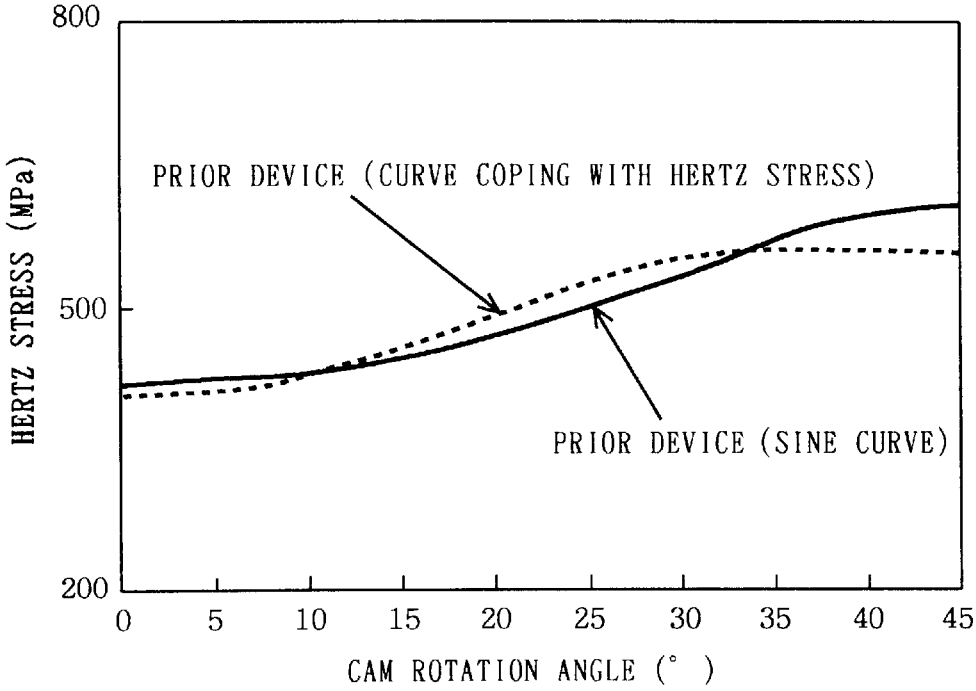
FIG. 10 is a diagram showing a stress characteristic of the variable delivery fuel supply device according to the prior art.

FIGS. 1 to 6 are drawings to explain a variable delivery fuel supply device according to Embodiment 1 of the invention. FIG. 1 is a system chart showing a construction of the variable delivery fuel supply device, FIG. 2 is a sectional view of a high-pressure fuel pump, FIG. 3 is a chart showing a lift characteristic of a plunger with respect to a cam rotational angle of the high-pressure fuel pump, FIG. 4 is a diagram to explain timing for operating an electromagnetic valve, FIG. 5 is a comparative diagram showing characteristics of a discharge flow rate with respect to the rotational angle of the cam of the high-pressure fuel pump, and FIG. 6 is a comparative diagram showing characteristics of Hertz stress with respect to the rotational angle of the cam of the high-pressure fuel pump.

Referring to FIG. 1, reference numerals 1*a* to 1*d* are fuel injection valves arranged in each of the cylinders of an internal combustion engine respectively, numeral 2 is a delivery pipe for holding pressurized fuel and supplying the fuel to the respective fuel injection valves 1*a* to 1*d*, numeral 3 is a high pressure fuel pump for supplying the pressure fuel to the delivery pipe 2 through a fuel passage 4, numeral 5 is a low pressure fuel pump for supplying the fuel from a fuel tank 6 through a fuel passage 7 to the high pressure fuel pump 3, numeral 8 is a check valve being arranged in the fuel passage 7 and maintaining the fuel pressure of the fuel passage 7 for a fixed time when, for example, the internal combustion engine is suspended, numeral 9 is a low pressure regulator for maintaining the fuel pressure of the fuel passage 7 at a predetermined pressure, numeral 10 is a check valve for relieving the fuel from the fuel passage 4 through a relief passage 11 to the fuel tank 6 when the fuel pressure of the delivery pipe 2 exceeds a predetermined value, and numeral 12 is a return passage for returning the fuel from the high pressure fuel pump 3 to the fuel tank 6.

In the high-pressure fuel pump 3 in FIG. 2, numeral 13 is a cylinder, and numeral 14 is a plunger being driven through a roller 16 by a cam 15 arranged on a camshaft and reciprocating in the cylinder 13 to take (suck) the fuel into a pressurization chamber 17 and pressurize the fuel. Numeral 18 is a spring for urging the plunger 14 at all times to a direction of enlarging the pressurization chamber 17, numeral 19 is a spring for urging the roller 16 toward the cam 15, numeral 20 is a bellows for sealing and preventing the fuel once leaked out from a gap between the cylinder 13 and the plunger 14 from entering into the internal combustion engine, and the fuel entered into the bellows 20 is returned to the fuel tank 6 through the return passage 12 in FIG. 1. Numeral 21 is a fuel intake port having a low-pressure dumper 22 and being supplied with the fuel from the fuel passage 7, and numeral 23 is a fuel discharge port connected to the delivery pipe 2 through the fuel passage 4. The fuel intake port 21 is connected with the pressurization chamber 17 through a fuel intake passage 24 and an intake valve 25 comprised of a nonreturn valve such as lead valve, and the fuel discharge port 23 is connected to the pressurization chamber 17 through a discharge valve 26 such as lead valve.

Numeral 27 is an electromagnetic valve normally closed and open upon receiving a signal from control means not shown in the drawings. A valve portion comprised of a valve body 28 and a valve seat 29 is arranged to open and close a relief passage 30 connecting the pressurization chamber 17 and the fuel intake passage 24, and the pressurized fuel in the pressurization chamber 17 is relieved through the relief passage 30 to the fuel intake passage 24 by opening the electromagnetic valve 27. The high pressure fuel pump 3 is mounted on the internal combustion engine and driven by the cam 15 arranged on the camshaft of the internal combustion engine, and pressurizes the fuel and delivers it with pressure to the delivery pipe 2 as the internal combustion engine rotates. The control means not shown is constructed to input engine speed of the internal combustion engine, rotational angle of the camshaft, fuel pressure of the delivery pipe 2, and so on, from sensors mounted on the vehicle and transmits a valve-opening signal to the electromagnetic valve 27. Numeral 31 in FIG. 1 is a check valve for maintaining the fuel pressure of the delivery pipe 2 for a certain time in the case that, for example, the internal combustion engine is suspended. Also, numeral 32 is a low pressure dumper.

Operation of the variable delivery fuel supply device according to this Embodiment 1 is hereinafter described.

In the variable delivery fuel supply device above construction, first, when a key switch of the internal combustion engine is turned on, the electromotive low pressure fuel pump 5 is actuated to supply the fuel from the fuel tank 6 to the high pressure fuel pump 3. Subsequently, the high-pressure fuel pump 3 is driven as the internal combustion engine starts its operation. In the intake stroke of the plunger 14, the discharge valve 26 is closed and the intake valve 25 is opened, and the fuel is taken into the pressurization chamber 17 through the fuel intake port 21 and the fuel intake passage 24. In the discharge stroke of the plunger 14, the intake valve 25 is closed and the discharge valve 26 is opened, and the pressurized fuel is delivered with pressure from the fuel discharge port 23 through the fuel passage 4 to the delivery pipe 2. In the intake stroke of the plunger 14, the discharge valve 26 is closed to prevent counter flow of the fuel. And when the internal combustion engine is suspended, the check valve 31 for maintaining the fuel pressure maintains the fuel passage 4 and the delivery pipe 2 at a high pressure.

Reciprocal movement of the plunger 14 becomes higher as the engine speed of the internal combustion engine is increased. Under this condition, the electromagnetic valve 27 operates in the following manner. That is, the control means not shown computes the discharge quantity on the basis of the fuel necessary for the fuel injection valves 1*a* to 1*d* and the feedback of the fuel pressure in the delivery pipe 2 to determine the time for opening the electromagnetic valve 27, a valve-opening signal is given to the electromagnetic valve 27 thereby opening the valve and connecting the pressurization chamber 17 of a high fuel pressure to the fuel intake passage 24 of a low fuel pressure, the pressurized delivery of the fuel from the pressurization chamber 17 to the delivery pipe 2 is stopped by relieving the fuel pressure, and the fuel pressure in the delivery pipe 2 is maintained constant. Accordingly, the fuel pressure of the delivery pipe 2 is maintained at a predetermined value, and the fuel consumed by the respective fuel injection valves 1*a* to 1*d* is supplied from the high-pressure fuel pump 3 to the delivery pipe 2 other than under operation at a high load. The electromagnetic valve 27 is opened in the middle of the discharge stroke of the plunger 14. When the load of the internal combustion engine increases, the fuel consumption also increases and the valve-opening time becomes short. As mentioned above, in the conventional variable delivery fuel supply device, the valve is kept closed throughout the whole stroke of the discharge stroke and the intake stroke when the load is high.

On the other hand, in the variable delivery fuel supply device according to Embodiment 1 of the invention, as shown in FIG. 4, under normal operation of the internal combustion engine, the electromagnetic valve 27 is opened at a lift position (a) of the plunger 14 corresponding to the fuel consumption to control the fuel pressure of the delivery pipe 2, but when the lift amount of the plunger 14 has reached the position of (b), a valve-opening signal is delivered from the control means not shown regardless of the fuel pressure of the delivery pipe 2, whereby the electromagnetic valve 27 is controlled to open without fail. The lift amount of the plunger 14 at this position (b) is established to be at a position 80 to 90% from the bottom dead point side in the whole lift amount. Accordingly, the range, in which the high-pressure fuel pump 3 can discharge the fuel, extends from the bottom dead point to a position lifting 80 to 90% therefrom.

The discharge quantity of the high-pressure fuel pump 3 is decreased by arranging the valve to open without fail at a position 80 to 90% from the bottom dead point side. For that purpose, in the cam 15, a base diameter (a small diameter portion of the cam) is small-sized without changing the external diameter of the cam top shown in FIG. 2, the lift curve is formed of only primary components excluding components of any higher order, and the whole lift amount of the plunger 14 is increased, for example, to 1/(0.8 to 0.9) times as shown in FIG. 3 in order to assure the discharge quantity per stroke even when the valve is opened at the position (b).

By constructing the device as described above, change in discharge quantity per stroke of the plunger 14 is improved as shown in FIG. 5 in comparison with the conventional example. The whole discharge quantity is secured and the discharge operation is completed before the rotational angle of the cam 15 reaches 45°, i.e., before the roller 16 comes to ride on a portion whose radius of curvature is small near the cam top of the cam 15 in FIG. 2. In the dischargeable range, the linearity of the discharge flow rate characteristic becomes superior especially in the vicinity of the maximum discharge quantity, and it becomes possible to improve accuracy in controlling the discharge flow rate. The Hertz stress acting between the cam 15 and the roller 16 is largely lowered, as shown in FIG. 6, because the electromagnetic valve 27 is opened without fail at the maximum lift position of the plunger 14 where the Hertz stress is maximum and the pressure of the pressurization chamber 17 is lowered, and it is possible to largely decrease the abrasion of the cam 15 without inviting resonance of the plunger 14 due to addition of any component of higher order to the lift curve of the cam 15.

The electromagnetic valve 27 is opened without fail, and consequently, the pressure does not remain in the pressurization chamber 17 even in the step of shifting to the intake stroke. Accordingly, shifting to the intake stroke can be smoothly performed, making it possible to prevent shortening of durability due to cavitation and so on. Furthermore, even in the case that abrasion occurs between the cam 15 and the roller 16 due to poor smoothness and the stroke of the plunger 14 is reduced due to the abrasion occurred on the external diameter of the cam 15, it is possible to compensate the lowering in discharge flow rate by adjusting the dischargeable range, i.e., the position of the point (b) in FIG. 4 by the valve-opening signal width and changing the position of completing the discharge from the 80% position to the 90% position of the lift amount, for example.

It is to be understood that the invention is not limited to the foregoing embodiments and various changes and modifications may be made without departing from the spirit and scope of the invention.

What is claimed is:

1. A variable delivery fuel supply device comprising:

fuel injection valves respectively for injecting a fuel to cylinders of an internal combustion engine;

a delivery pipe for supplying a pressurized fuel to said fuel injection valves; and a fuel pump for taking a fuel from a intake passage through an intake valve into a pressurization chamber during an intake stroke, for pressurizing said fuel and for discharging the pressurized fuel through a discharged valve to said delivery pipe during a discharge stroke by reciprocating movement of a plunger in each cylinder from a bottom dead point to a top dead point;

wherein the pressure in said pressurization chamber is relieved at a position set to a predetermined valve before reaching the top dead point in the course of the discharge stroke in which the plunger of said fuel pump moves from the bottom dead point to the top dead point, regardless of a fuel pressure in the delivery pipe.

2. The variable delivery fuel supply device according to claim 1, further comprising an electromagnetic valve for controlling a discharge quantity of the fuel pump to control the fuel pressure of the delivery pipe by connecting the fuel intake passage and the pressurization chamber, wherein the pressure in the pressurization chamber is relieved by opening the electromagnetic valve at a set position.

3. The variable delivery fuel supply device according to claim 1, wherein the position of the plunger where the pressure in the pressurization chamber is relieved is established to be at 80 to 90% from the bottom dead point side in the whole stroke of the plunger from the bottom dead point to the top dead point.

4. The variable delivery fuel supply device according to claim 1, wherein the electromagnetic valve is a normally closed valve, which opens when the discharge quantity is controlled and when the pressure in the pressurization chamber is relieved.

* * * * *